US008439228B1

(12) United States Patent
Graham

(10) Patent No.: US 8,439,228 B1
(45) Date of Patent: May 14, 2013

(54) MULTI-CHAMBERED CONTAINER AND ASSOCIATED METHOD

(76) Inventor: Virginia Graham, Rosemead, CA (US)

( * ) Notice: Subject to any disclaimer, the term of this patent is extended or adjusted under 35 U.S.C. 154(b) by 1149 days.

(21) Appl. No.: 12/321,576

(22) Filed: Jan. 22, 2009

Related U.S. Application Data

(60) Provisional application No. 61/062,094, filed on Jan. 24, 2008.

(51) Int. Cl.
*B67D 7/06* (2010.01)
*B65D 37/00* (2006.01)

(52) U.S. Cl.
USPC ..... 222/144.5; 222/212; 222/94; 222/545; 222/519; 222/481

(58) Field of Classification Search ..... 222/144.5, 222/212, 213, 215, 94, 545, 519, 481
See application file for complete search history.

(56) References Cited

U.S. PATENT DOCUMENTS 5,433,350 A * 7/1995 Graubart ..... 222/136
6,769,573 B1 * 8/2004 Kazarian et al. ..... 222/136

* cited by examiner

*Primary Examiner* — Kevin P Shaver
*Assistant Examiner* — Melvin Cartagena

(57) ABSTRACT

A multi-chambered container for selectively storing and dispensing a plurality of items may include predetermined quantities of first and second items and a container having a divided cavity formed therein. The container may further have a spout formed at a top end thereof and in fluid communication with the cavity. Additionally, the container may have first and second mutually exclusive passageways extending from the cavity and terminating at the spout. A mechanism may be included for selectively dispensing one of the first and second items from the spout. Such a mechanism may channel one item along a corresponding passageway while prohibiting another item from being dispensed. The mechanism may be operated by rotating a cam and semicircular disc to position an opening on a simultaneously rotated wheel over the desired passageway. The mechanism may rotate the opening 180 degrees for every 360 degree rotation of the cam.

14 Claims, 6 Drawing Sheets

MULTI-CHAMBERED CONTAINER AND ASSOCIATED METHOD

CROSS REFERENCE TO RELATED APPLICATIONS

This application claims the benefit of U.S. Provisional Application No. 61/062,094, filed Jan. 24, 2008, the entire disclosures of which are incorporated herein by reference.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Technical Field

This invention relates to containers and, more particularly, to a multi-chambered container for selectively storing and dispensing a plurality of items.

2. Prior Art

There are many products which are used together, such as shampoo and hair conditioner, ketchup and mustard, and oil and vinegar. These products are generally provided in two separate containers. Thus, the end-user must keep separate bottles together. For example, after shampooing, it may be difficult for a person in the shower to find a separate conditioner bottle. It is thus desirable to be able to store these related products together so that both may be readily available at the same time. Dual containers, per se, are known in the prior art. For example, one prior art example shows a pair of containers which, as disclosed, are bonded together or may be held together by shrink wrap. This provides for two containers which are either held together as a unit or are separate.

There are several disadvantages to this approach, one being the fact that the user must still keep track of two separate containers. For example, should one of the containers become misplaced when temporarily separated from the other, the purpose of the prior art invention will have, in effect, been defeated. Furthermore, although convenient, the coupling of such containers culminates in a rather bulky unit that is difficult to store and cumbersome to manipulate manually.

U.S. Pat. No. 5,158,191 to Douglas discloses a dual container having two bottles which are releasably interlocked together in side-by-side relation by a mortise and tenon. The bottles are held together to prevent undesired relative movement between the two bottles. A single cap covers both bottles. The cap has a separate outlet for each bottle which may be opened independently of each other. Unfortunately this prior art reference does not disclose an apparatus featuring one bottle that is divided into two compartments thereby reducing the risk of the bottles becoming separated from each other.

U.S. Pat. No. 5,316,159 to Douglas discloses a dual bottle container having two bottles which are releasably interlocked together in side-by-side relation by a plateau on one of the bottles which engages a depression on the other bottle for transverse sliding movement. The plateau is bordered at opposite sides by rounded lip portions and the depression is bordered at opposite sides by rounded groove portions. The lip portions and the groove portions engage each other to prevent undesired relative movement between the two bottles. Unfortunately this prior art reference does not provide the user with a means of cutting down on clutter and keeping related products continuously together as it still requires two separate bottles instead of one.

U.S. Pat. No. 5,921,440 to Maines discloses a multi-compartment container that is made from previously formed partial bottles and two "half-bottles" that are individually formed from a pliable plastic with a semicircular wall on one side and a flat wall on the other side, as by blow molding. The two half-bottles are joined together with the flat walls in juxtaposition to define the body portion of the multi-compartment container, with each "half-bottle" serving as one of its compartments or chambers. A cap with a dispenser for each compartment serves as a cover for the container. The pliable plastic from which the container is formed enables a person to squeeze either of the compartments to dispense from one of the compartments or squeeze both compartments to dispense from both compartments. One embodiment of the invention includes a dial-a-matic selection system adapted, but not restricted, to the dispensing of mustard and ketchup. Unfortunately, this prior art reference does not disclose a means of easily and correctly aligning the cap opening over the desired chamber.

Accordingly, a need remains for a multi-chambered container in order to overcome the above-noted shortcomings. The present invention satisfies such a need by providing a device that is convenient and easy to use, is durable yet lightweight in design, is versatile in its applications, and provides a means of selectively storing and dispensing a plurality of items.

BRIEF SUMMARY OF THE INVENTION

In view of the foregoing background, it is therefore an object of the present invention to provide an apparatus for selectively, storing and dispensing a plurality of items. These and other objects, features, and advantages of the invention are provided by a multi-chambered container.

A multi-chambered container for selectively storing and dispensing a plurality of items may include a predetermined quantity of a first item, a predetermined quantity of a second item, and a container having a cavity formed therein. Such a cavity may be adapted to store and isolate the first and second items therein. The container may be constructed of plastic, aluminum, glass, or a variety of other materials known by those skilled in the art and appropriate for storage of desired items. The container may be utilized to store items such as ketchup and mustard, shampoo and conditioner, laundry detergent and bleach, and a multitude of other item combinations as desired by consumers to provide an advantageous assemblage in one convenient to store and use container.

In addition, the container may have a spout formed at a top end thereof which may be in fluid communication with the cavity. The container may further have first and second mutually exclusive passageways extending from the cavity and terminating at the spout. The spout may be produced in a variety of lengths, widths, and shapes to advantageously provide the user with the best manner of applying the items housed within the container for the intended use. Additionally, a mechanism may be included for selectively dispensing one of the first and second items from the spout. Such a mechanism may channel one item along a corresponding one of the first and second passageways while prohibiting another one of the first and second items from being dispensed out from the spout. The first and second passageways may remain spaced apart along an entire longitudinal length of the cavity. In this manner, the items may be continuously kept separate from each other to prevent unwanted mixture. The mechanism may permit the user to quickly and easily select which item is to be dispensed at the desired time.

The selectively dispensing mechanism may additionally include a divider statically nested inside the cavity and configured in such a manner that the cavity may be bifurcated into a plurality of isolated compartments. Each of the isolated compartments may be adapted to separately store one of the first and second items. In addition, the divider may remain at a fixed and stationary position while the selectively dispensing mechanism is toggled between the open and closed positions. The divider may ensure the stored items do not come in contact with each other in order to allow the user to dispense each item individually as desired.

The selectively dispensing mechanism further may include a cam shaft having a bottom end seated within the spout and further having a top end exposed above the spout. The top end of the cam shaft further may be centrally registered above the spout for receiving a user input. The top end of the cam may be configured in such a manner to allow the user to easily rotate the cam by hand to open the desired compartment and dispense the items housed therein.

The mechanism may also include a bottom wheel rotatably connected to the spout. The bottom wheel may be configured in such a manner that the bottom wheel may be intermittently rotated as the cam shaft is continuously rotated. The bottom wheel may additionally have an opening set interior of, and extended less than 180 degrees along, the circumference of the wheel. In this manner, the opening may be positioned above one of the compartments and may not extend over the divider, thereby advantageously preventing the second item from being dispensed while the first item is allowed to egress the opening into the spout. In operation, the first and second passageways may be intermittently biased between open and closed positions as the bottom wheel and opening become intermittently offset and aligned with the first and second passageways. In this manner, the first and second items may be intermittently permitted and intermittently prohibited from egressing the spout respectively.

The selectively dispensing mechanism further may include a top disc statically mated to the cam shaft and situated above the bottom wheel. The top disc may be eccentrically juxtaposed above the bottom wheel such that the top disc may rotate along an eccentric curvilinear path defined inwardly from an outer perimeter of the bottom wheel. The cam shaft may therefore be offset from the center of the bottom wheel such that the top disc may rotate about an axis distinct from the center of the bottom wheel. In addition, first and second stop members may be directly affixed to a top surface of the bottom wheel. The first and second stop members may be intermittently engaged with the top disc as the top disc continuously rotates along the eccentric curvilinear path to thereby intermittently rotate the bottom wheel between the open and closed positions respectively. Additionally, the first and second stop members may be oppositely positioned on the bottom wheel and may remain approximately 180 degrees apart as the top disc and the bottom wheel are rotated.

In operation, the user may rotate the cam shaft manually to rotate the top disc. As the top disc spins, it may come in frictional contact with the first or second stop member to thereby rotate the bottom wheel accordingly. Thus, by turning the top end of the cam shaft, the user may advantageously reposition the opening of the bottom wheel over the desired compartment to thereafter dispense the item housed therein.

The cam shaft and the top disc may further be continuously rotated in sync along a first rotational direction as the bottom wheel is intermittently rotated along the first rotational direction. In this manner, the bottom wheel may rotate only when the top disc comes in contact with the first or second stop member. This provides the vital and advantageous benefit of stopping the rotation of the bottom wheel where the opening is positioned only over one compartment, to allow for an item to be dispensed from that compartment only. For each 360 degree rotation of the top disc, it may come in contact with only one of the first or second stop members, and may rotate the bottom wheel only 180 degrees. Thus, a user may rotate the cam shaft in one complete revolution to reposition the opening of the bottom wheel from above one compartment, to above the second compartment.

The top disc may further include a shoulder protruding outwardly from an outer perimeter of the top disc. The top disc may be intermittently engaged with the first and second stop members by way of the shoulder and may thereby cause the bottom wheel to intermittently rotate along a semi-spherical path extending approximately 180 degrees as the cam shaft and the top disc rotate 360 degrees. Additionally, the first and second stop members may intermittently travel along the eccentric curvilinear path such that the first and second stop members may become intermittently engaged and disengaged from the shoulder upon reaching a beginning point and an end point of the semi-spherical path respectively. In operation, the beginning and ending points may be alternately aligned with the open top ends of the first and second passageways respectively during each complete revolution of the cam shaft. Thus, the shoulder of the top disc may move the bottom wheel by way of the first or second stop members to reposition the opening of the bottom wheel over the desired compartment.

As an example, when the opening of the bottom wheel is positioned over a first chamber, the user may rotate the cam shaft to reposition it over the second chamber. As the cam shaft rotates, and the shoulder of the top disc comes in frictional contact with the first stop member, it may urge the first stop member along the first rotational direction 180 degrees. When the first stop member completes its 180 degree rotation, the shoulder may disengage frictional contact therewith, and may travel freely until it comes in frictional contact with the second stop member, which will have been rotated along with the bottom wheel and repositioned to where the first stop member started its rotation. As the stop members will have effectively switched positions in relation to the container, the opening of the bottom wheel will also have been repositioned from one side of the container to the other.

The present invention may further include a method for selectively storing and dispensing a plurality of items in a container. Such a method may include the chronological steps of first providing a predetermined quantity of a first item. Second, the method may include providing a predetermined quantity of a second item. Next, the method may include a third step of providing a single and unitary hollow container having a cavity formed therein. Fourth, the method may include depositing and isolating the first and second items in the cavity. The container may further have a spout formed at a top end thereof which may be in fluid communication with the cavity. In addition, the container may have first and second mutually exclusive passageways extending from the cavity and terminating at the spout. A fifth step of the method may include providing a mechanism for selectively dispensing one of the first and second items from the spout by channeling one item along a corresponding one of the first and second passageways while prohibiting another one of the first and second items from being dispensed out from the spout. Finally, a sixth step may include, after dispensing a desired quantity of the one item, selectively adapting the selectively dispensing mechanism to a closed position for prohibiting each of the first and second items from ingressing and egressing the spout respectively.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

It is noted the purpose of the foregoing abstract is to enable the U.S. Patent and Trademark Office and the public generally, especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

BRIEF DESCRIPTION OF THE SEVERAL VIEWS OF THE DRAWING

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

Figure 1:
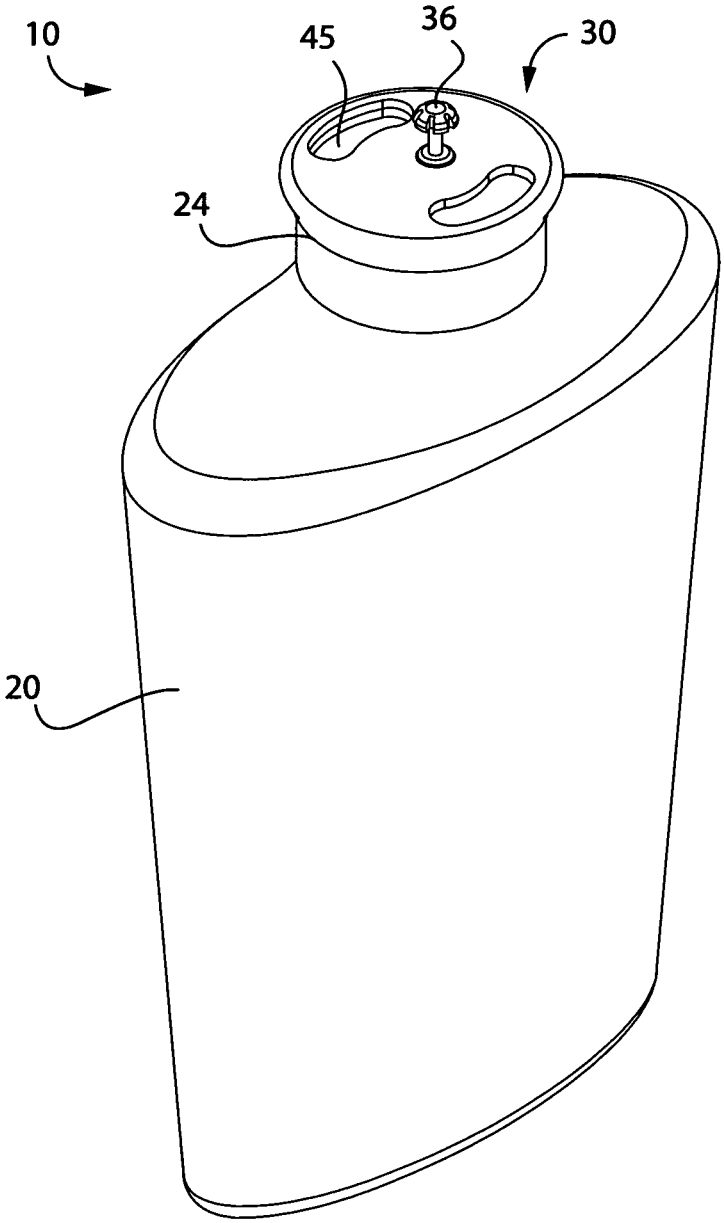
FIG. 1 is a perspective view showing a multi-chambered container, in accordance with the present invention.
Figure 2:
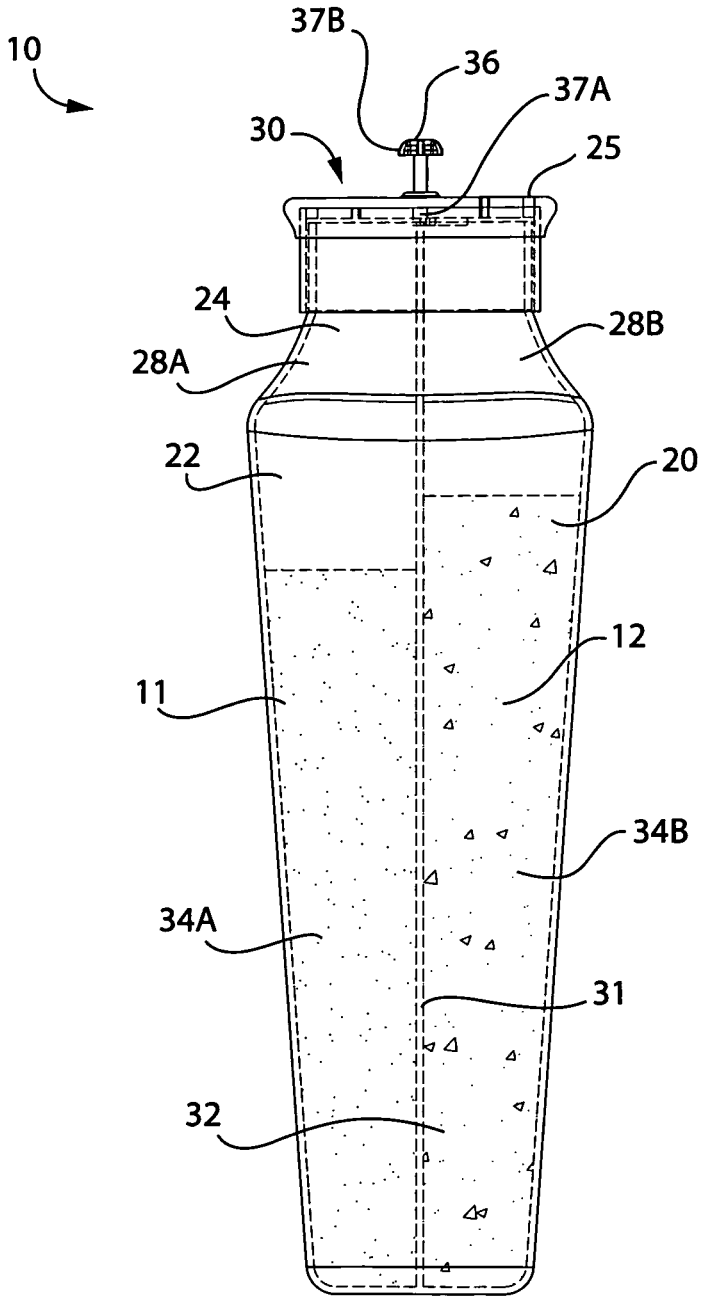
FIG. 2 is a side cross-sectional view of the apparatus shown in FIG. 1, displaying the first and second items housed within the isolated compartments.
Figure 3:
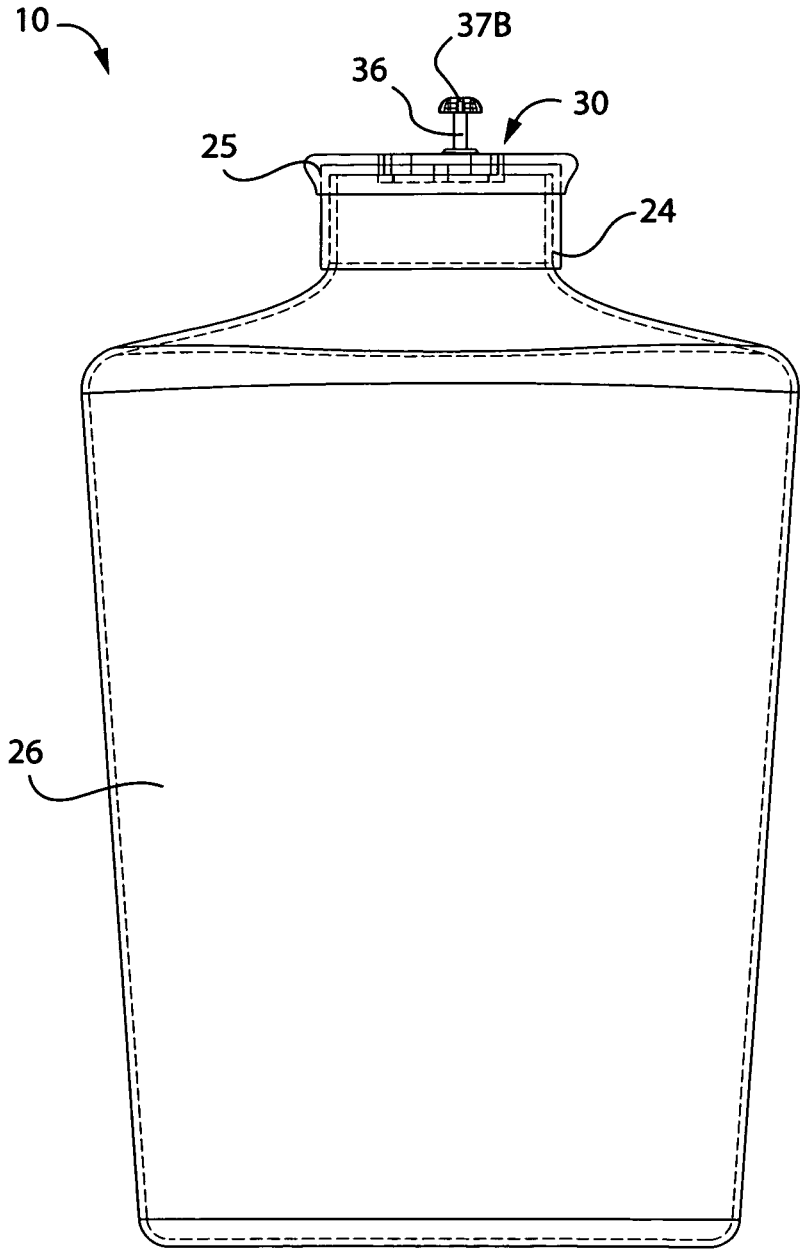
FIG. 3 is a front cross-sectional view of the apparatus shown in FIG. 1, showing the offset placement of the cam shaft in relation to the center of the container.
Figure 4:
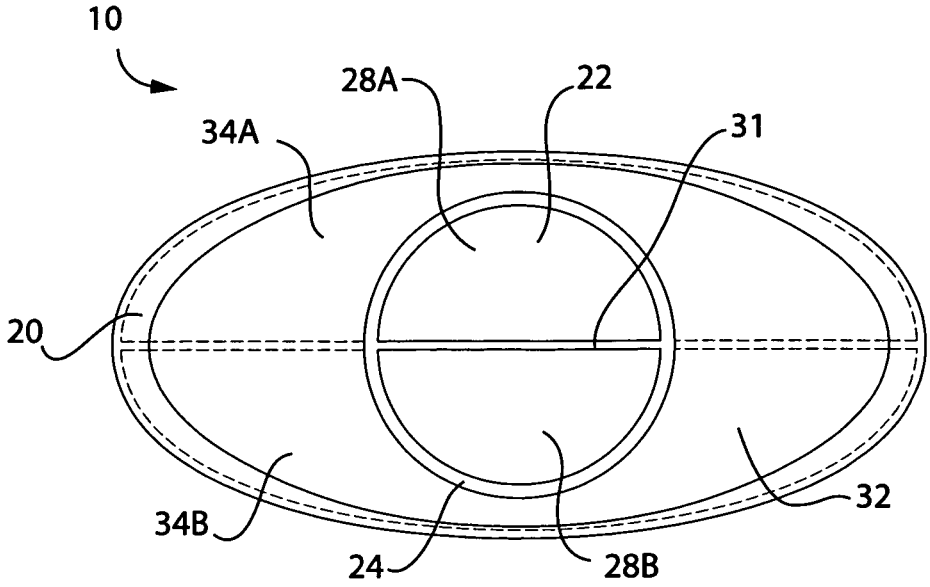
FIG. 4 is a top cross-sectional view of the apparatus shown in FIG. 1, showing the divider set between the mutually exclusive passageways.
Figure 5A:
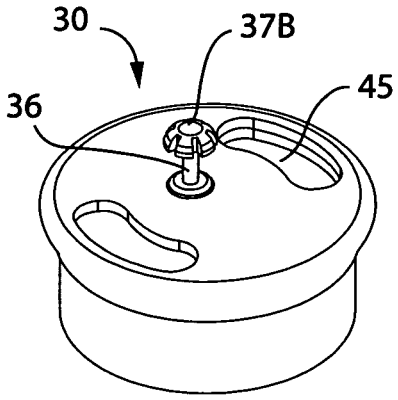
FIG. 5*a* is a perspective view of the spout of the multi-chambered container with the opening of the bottom wheel rotated to a position aligned with the first compartment.
Figure 5B:
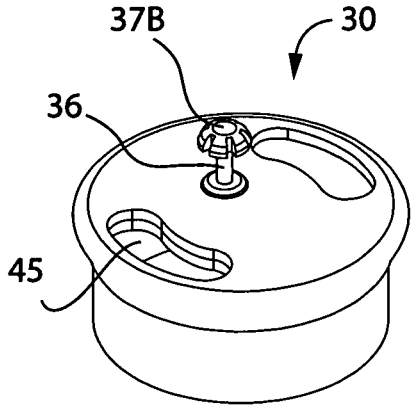
FIG. 5*b* is a perspective view of the spout shown in FIG. 5*a*, with the opening of the bottom wheel rotated to a position aligned with the second compartment.

The present invention will now be described more fully hereinafter with reference to the accompanying drawings, in which a preferred embodiment of the invention is shown. This invention may, however, be embodied in many different forms and should not be construed as limited to the embodiment set forth herein. Rather, this embodiment is provided so that this application will be thorough and complete, and will fully convey the true scope of the invention to those skilled in the art. Like numbers refer to like elements throughout the figures.

The apparatus of this invention is referred to generally in FIGS. 1-7*b* by the reference numeral 10 and is intended to provide a multi-chambered container. It should be understood that the multi-chambered container 10 may be used to house and dispense many different combinations and types of items, liquid or otherwise.

Initially referring in general to FIGS. 1-7*b*, a multi-chambered container 10 for selectively storing and dispensing a plurality of items may include a predetermined quantity of a first item 11, a predetermined quantity of a second item 12, and a container 20 having a cavity 22 formed therein. Such a cavity 22 may be adapted to store and isolate the first and second items 11, 12 therein. The container 20 may be constructed of plastic, aluminum, glass, or a variety of other materials known by those skilled in the art and appropriate for storage of desired items. The container 20 may be utilized to store items commonly kept together such as ketchup and mustard, shampoo and conditioner, laundry detergent and bleach, and a multitude of other item combinations as desired by consumers to provide an advantageous assemblage in one convenient to store and use container 20.

Referring now to FIGS. 1-4, the container 20 may additionally have a spout 24 formed at a top end 25 thereof which may be in fluid communication with the cavity 22. The container 20 may further have first and second mutually exclusive passageways 28A, 28B extending from the cavity 22 and terminating at the spout 24. The spout 24 may be produced in a variety of lengths, widths, and shapes to advantageously provide the user with the best manner of applying the items housed within the container 20 for the intended use. Additionally, a mechanism 30 may be included for selectively dispensing one of the first and second items 11, 12 from the spout 24. Such a mechanism 30 may channel one item along a corresponding one of the first and second passageways 28A, 28B while prohibiting another one of the first and second items 11, 12 from being dispensed out from the spout 24. The first and second passageways 28A, 28B may remain spaced apart along an entire longitudinal length of the cavity 22. In this manner, the items may be continuously kept separate from each other to prevent unwanted mixture. The mechanism 30 may permit the user to quickly and easily select which item is to be dispensed at the desired time.

Referring now to FIGS. 2, 4, 7*a* and 7*b*, the selectively dispensing mechanism 30 may additionally include a divider 31 statically nested inside the cavity 22 and configured in such a manner that the cavity 22 may be bifurcated into a plurality of isolated compartments 32. Each of the isolated compartments 34A, 34B may be adapted to separately store one of the first and second items 11, 12. In addition, the divider 31 may remain at a fixed and stationary position while the selectively dispensing mechanism 30 is toggled between the open and closed positions. The divider 31 may ensure the stored items 11, 12 do not come in contact with each other in order to allow the user to dispense each item individually as desired.

Now referring to FIGS. 1-3, 5*a*, 5*b*, 7*a*, and 7*b*, the selectively dispensing mechanism 30 further may include a cam shaft 36 having a bottom end 37A seated within the spout 24 and further having a top end 37B exposed above the spout 24. The top end 37B of the cam shaft 36 further may be centrally registered above the spout 24 for receiving a user input. The top end 37B of the cam shaft 36 may be configured in such a manner to allow the user to easily rotate the cam shaft 36 by hand to open the desired compartment 34A, 34B and dispense the items 11, 12 housed therein.

More specifically referring to FIGS. 6*a*-6*c*, 7*a*, and 7*b*, the mechanism 30 may also include a bottom wheel 40 rotatably connected to the spout 24. The bottom wheel 40 may be configured in such a manner that the bottom wheel 40 may be intermittently rotated as the cam shaft 36 is continuously rotated. The bottom wheel 40 may additionally have an opening 45 set interior of, and extended less than 180 degrees along, the circumference of the wheel 40. In this manner, the opening 45 may be positioned above one of the compartments 34A, for example, and may not extend over the divider 31, thereby advantageously preventing the second item 12 from being dispensed while the first item 11 is allowed to egress the opening 45 into the spout 24.

In operation, the first and second passageways 28A, 28B may be intermittently biased between open and closed positions as the bottom wheel 40 and opening 45 become intermittently offset and aligned with the first and second passageways 28A, 28B, respectively. In this manner, the first and second items 11, 12 may be intermittently permitted and intermittently prohibited from egressing the spout 24, respectively.

Again referring to FIGS. 6*a*-6*c*, 7*a*, and 7*b*, the selectively dispensing mechanism 30 further may include a top disc 50 statically mated to cam shaft 36 and situated above the bottom wheel 40. The top disc 50 may be eccentrically juxtaposed above the bottom wheel 40 such that the top disc 50 may rotate along an eccentric curvilinear path defined inwardly from an outer perimeter of the bottom wheel 40. The cam shaft 36 may therefore be offset from the center of the bottom wheel 40 such that the top disc 50 may rotate about an axis distinct from the center bottom wheel 40.

In addition, first and second stop members 42A, 42B may be directly affixed to a top surface of the bottom wheel 40. The first and second stop members 42A, 42B may be intermittently engaged with the top disc 50 as the top disc 50 continuously rotates along the eccentric curvilinear path to thereby intermittently rotate the bottom wheel 40 between the open and closed positions respectively. Additionally, the first and second stop members may be oppositely positioned on the bottom wheel 40 and may remain approximately 180 degrees apart as the top disc 50 and the bottom wheel 40 are rotated.

In operation, the user may manually rotate the cam shaft 36 and thereby rotate the top disc 50. As the top disc 50 rotates, it may come in frictional contact with the first or second stop member 42A, 42B to thereby rotate the bottom wheel 40 accordingly. Thus, by turning the top end 37B of the cam shaft 36, the user may advantageously reposition the opening 45 of the bottom wheel 40 over the desired compartment 34A, 34B to thereafter dispense the item housed therein.

Figure 6A:
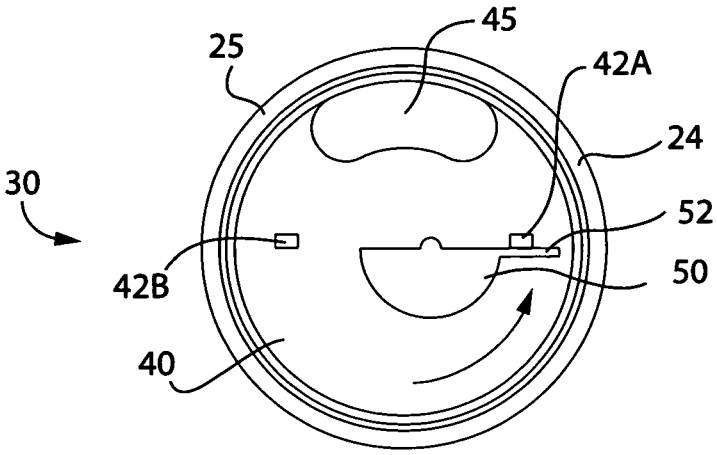
FIGS. 6*a*, 6*b*, and 6*c* are isolated top plan views of the cam section separated from the container, wherein the cam section is rotated 180 degrees as the cam shaft is rotated 360 degrees.
Figure 6B:
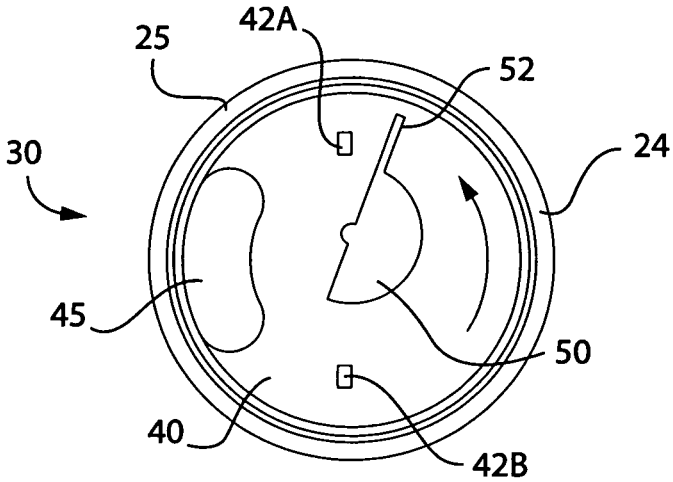
Figure 6C:
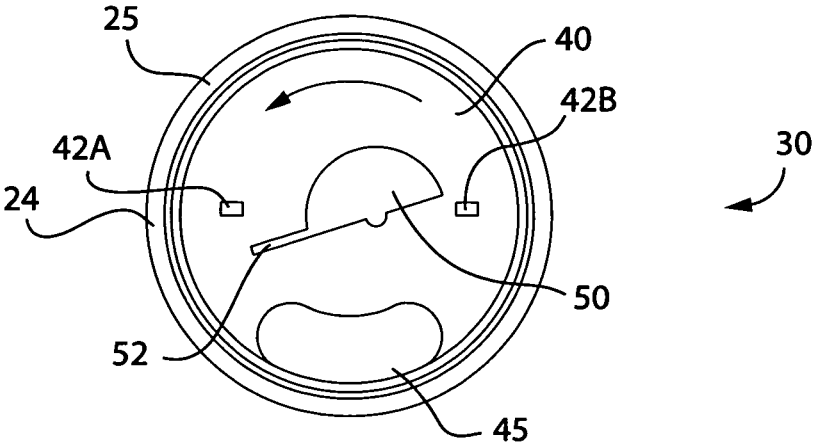
Figure 7A:
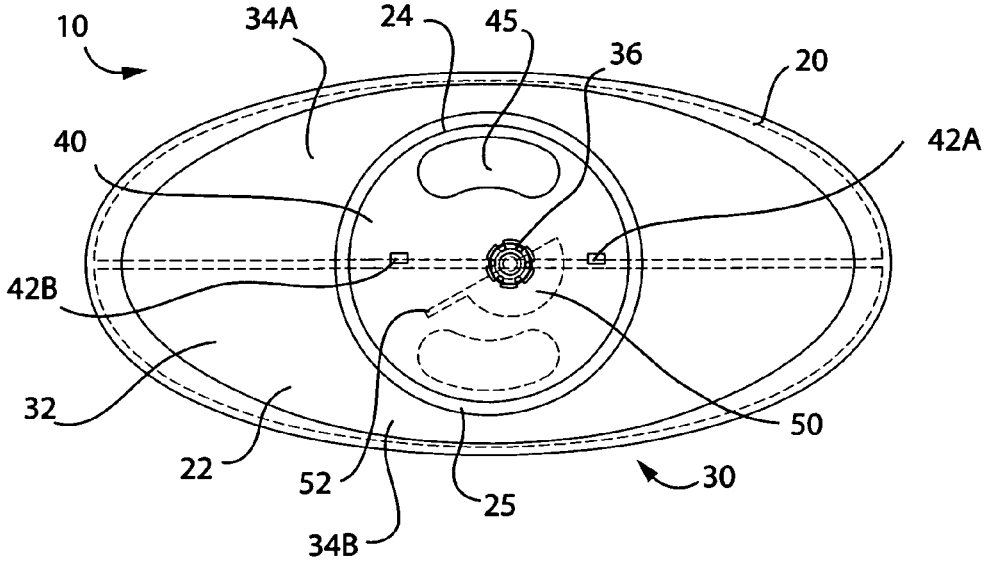
FIG. 7*a* is a top plan view of the multi-chambered container, showing the opening of the bottom wheel aligned with the first compartment.
Figure 7B:
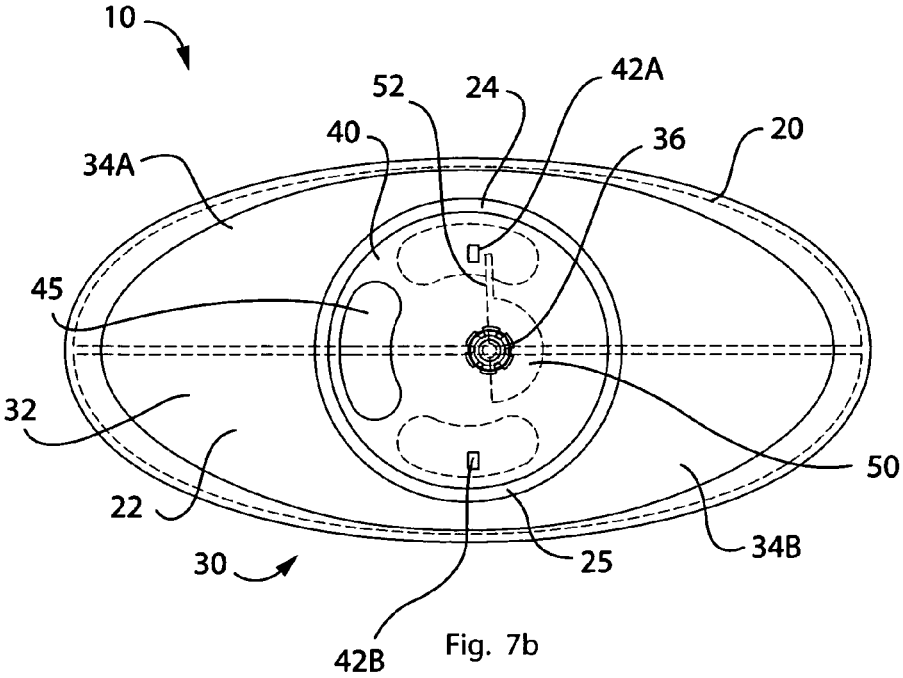
FIG. 7*b* is a top plan view of the apparatus shown in FIG. 7*a*, showing the cam shaft and top disc rotated 90 degrees and both the first and second compartments closed.

Referring specifically to FIGS. 6*a*-6*c*, the top disc 50 may further be continuously rotated in sync along a first rotational direction as the bottom wheel 40 is intermittently rotated along the first rotational direction. In this manner, the bottom wheel 40 may rotate only when the top disc 50 comes in contact with the first or second stop members 42A, 42B. This provides the vital and advantageous benefit of stopping the rotation of the bottom wheel 40 where the opening 45 is positioned only over one compartment 34A, 34B, to allow for an item to be dispensed from that compartment only.

For each 360 degree rotation of the top disc 50, it may come in contact with only one of the first or second stop members 42A, 42B, and may rotate the bottom wheel 40 only 180 degrees. Thus, a user may rotate the cam shaft 36 and top disc 50 in one complete revolution to reposition the opening 45 of the bottom wheel 40 from above one compartment 34A, to above the second compartment 34B.

Again referring to FIGS. 6*a*-6*c*, the top disc 50 may further include a shoulder 52 protruding outwardly from an outer perimeter of the top disc 50. The top disc 50 may be intermittently engaged with the first and second stop members 42A, 42B by way of the shoulder 52 and may thereby cause the bottom wheel 40 to intermittently rotate along a semi-spherical path extending approximately 180 degrees as the cam shaft 36 and the top disc 50 rotate 360 degrees. Additionally, the first and second stop members 42A, 42B may intermittently travel along the eccentric curvilinear path such that the first and second stop members 42A, 42B may become intermittently engaged and disengaged from the shoulder 52 upon reaching a beginning point and an end point of the semi-spherical path respectively.

In operation, the beginning and ending points may be alternately aligned with the open top ends of the first and second passageways 28A, 28B respectively during each complete revolution of the cam shaft 36. Thus, the shoulder 52 of the top disc 50 may move the bottom wheel 40 by way of the first or second stop members to reposition the opening 45 of the bottom wheel 40 over the desired compartment 34A, 34B. The combination of the offset top disc 50 with shoulder 52 and first and second stop members 42A, 42B utilized to rotate the bottom wheel 40 in 180 degree increments provides an unpredictable result not rendered obvious by one skilled in the art.

As an example, referring to FIGS. 6*a*-6*c*, when the opening 45 of the bottom wheel 40 is positioned over a first chamber (as seen in FIG. 6*a*), the user may rotate the cam shaft 36 to reposition it over the second chamber (as seen in FIG. 6*c*). As cam shaft 36 rotates the top disc 50, and the shoulder 52 of the top disc 50 comes in frictional contact with the first stop member 42A, it may urge the first stop member along the first rotational direction 180 degrees. When the first stop member 42A completes its 180 degree rotation, the shoulder 52 may disengage frictional contact with the first stop member 42A (as seen in FIG. 6*c*), and may travel freely until it comes in frictional contact with the second stop member 42B, which will have been rotated along with the bottom wheel 40 and repositioned to where the first stop member 42A started its rotation (as shown originally in FIG. 6*a*).

Because the stop members 42A, 42B will have effectively switched positions in relation to container 20, the opening 45 of the bottom wheel 40 will also have been repositioned from one side of the container 20 to the other, and from being positioned over one compartment 34A to over the second compartment 34B. The present invention, as claimed, provides the unexpected and unpredictable benefit of permitting the user to easily align the opening over the desired chamber by simply turning the cam shaft in a continuous motion in a single rotational direction without having to make repeated adjustments to obtain the correct alignment. Such a result is not rendered obvious by one skilled in the art.

Again referring to FIGS. 1-7*b* in general, the present invention may further include a method for selectively storing and dispensing a plurality of items in a container 20. Such a method may include the chronological steps of first providing a predetermined quantity of a first item 11. Second, the method may include providing a predetermined quantity of a second item 12. Next, the method may include a third step of providing a single and unitary hollow container 20 having a cavity 22 formed therein.

Fourth, the method may include depositing and isolating the first and second items 11, 12 in the cavity 22. The container 20 may further have a spout 24 formed at a top end 25 thereof which may be in fluid communication with the cavity 22. In addition, the container 20 may have first and second mutually exclusive passageways 28A, 28B extending from the cavity 22 and terminating at the spout 24. A fifth step of the method may include providing a mechanism 30 for selectively dispensing one of the first and second items 11, 12 from the spout 24 by channeling one item along a corresponding one of the first and second passageways while prohibiting another one of the first and second items from being dispensed out from the spout 24.

A sixth step may include, after dispensing a desired quantity of the one item, selectively adapting the selectively dispensing mechanism 30 to a closed position for prohibiting each of the first and second items 11, 12 from ingressing and egressing the spout 24 respectively.

In an alternative embodiment the container 20 may include three compartments with a divider 31 separating each compartment, and three stop members positioned upon the bottom wheel 40 and located 120 degrees from each other. Such a design would permit three items to be stored together in one easy to use container. Of course, other minor design changes may permit the container to be separated into a larger number of compartments, and the present invention should not be limited to the applications discussed herein.

While the invention has been described with respect to a certain specific embodiment, it will be appreciated that many modifications and changes may be made by those skilled in the art without departing from the spirit of the invention. It is intended, therefore, by the appended claims to cover all such modifications and changes as fall within the true spirit and scope of the invention.

In particular, with respect to the above description, it is to be realized that the optimum dimensional relationships for the parts of the present invention may include variations in size, materials, shape, form, function and manner of operation. The assembly and use of the present invention are deemed readily apparent and obvious to one skilled in the art.

What is claimed as new and what is desired to secure by Letters Patent of the United States is:

1. A multi-chambered container for selectively storing and dispensing a plurality of items, said multi-chambered container comprising:

a predetermined quantity of a first item;

a predetermined quantity of a second item;

a container having a cavity formed therein, said cavity being adapted to store and isolate said first and second items therein, said container further having a spout formed at a top end thereof and being in fluid communication with said cavity, said container further having first and second mutually exclusive passageways extending from said cavity and terminating at said spout; and means for selectively dispensing one of said first and second items from said spout by channeling said one item along a corresponding one of said first and second passageways while prohibiting another one of said first and second items from being dispensed out from said spout;

wherein said selectively dispensing means comprises:

a divider statically nested inside said cavity and configured in such a manner that said cavity is bifurcated into a plurality of isolated compartments, each of said isolated compartments being adapted to separately store one of said first and second items;

wherein said divider remains at a fixed and stationary position while said selectively dispensing means is toggled between said open and closed positions;

wherein said selectively dispensing means further comprises:

a cam shaft having a bottom end seated within said spout and further having a top end exposed above said spout, said top end of said cam shaft further being centrally registered above said spout for receiving a user input;

a bottom wheel rotatably connected to said spout, said bottom wheel being configured in such a manner that said bottom wheel is intermittently rotated as said cam shaft is continuously rotated; and wherein said first and second passageways are intermittently biased between open and closed positions as said bottom wheel becomes intermittently offset and aligned with said first and second passageways such that said first and second items are intermittently permitted and intermittently prohibited from egressing said spout respectively.

2. The multi-chambered container of claim 1, wherein said first and second passageways remain spaced apart along an entire longitudinal length of said cavity.

3. The multi-chambered container of claim 1, wherein said selectively dispensing means further comprises:

a top disc statically mated to said cam shaft and situated above said bottom wheel, said top disc being eccentrically juxtaposed above said bottom wheel such that said top disc rotates along an eccentric curvilinear path defined inwardly from an outer perimeter of said bottom wheel; and first and second stop members directly affixed to a top surface of said bottom wheel, said first and second stop members being intermittently engaged with said top disc as said top disc continuously rotates along said eccentric curvilinear path to thereby intermittently rotate said bottom wheel between the open and closed positions respectively.

4. The multi-chambered container comprising 3, wherein said first and second stop members are oppositely positioned on said bottom wheel and remain approximately 180 degrees apart as said top disc and said bottom wheel are rotated.

5. The multi-chambered container comprising 3, wherein said cam shaft and said top disc are continuously rotated in sync along a first rotational direction as said bottom wheel is intermittently rotated along said first rotational direction.

6. The multi-chambered container comprising 3, wherein said top disc comprises: a shoulder protruding outwardly from an outer perimeter of said top disc, said top disc being intermittently engaged with said first and second stop members and thereby causing said bottom wheel to intermittently rotate along a semi-spherical path extending approximately 180 degrees as said cam shaft and said top disc rotate 360 degrees.

7. The multi-chambered container comprising 6, wherein said first and second stop members intermittently travel along said eccentric curvilinear path such that said first and second stop members become intermittently engaged and disengaged from said shoulder upon reaching a beginning point and an end point of said semi-spherical path respectively;

wherein said beginning and ending points are alternately aligned with said open top ends of said first and second passageways respectively during each complete revolution of said cam shaft.

8. A multi-chambered container for selectively storing and dispensing a plurality of items, said multi-chambered container comprising:

a predetermined quantity of a first item;

a predetermined quantity of a second item;

a container having a cavity formed therein, said cavity being adapted to store and isolate said first and second items therein, said container further having a spout formed at a top end thereof and being in fluid communication with said cavity, said container further having first and second mutually exclusive passageways extending from said cavity and terminating at said spout; and means for selectively dispensing one of said first and second items from said spout by channeling said one item along a corresponding one of said first and second passageways while prohibiting another one of said first and second items from being dispensed out from said spout;

wherein said selectively dispensing means comprises a divider statically nested inside said cavity and configured in such a manner that said cavity is bifurcated into a plurality of isolated compartments, each of said isolated compartments being adapted to separately store one of said first and second items;

wherein said divider remains at a fixed and stationary position while said selectively dispensing means is toggled between said open and closed positions;

wherein said selectively dispensing means further comprises a cam shaft having a bottom end seated within said spout and further having a top end exposed above said spout, said top end of said cam shaft further being centrally registered above said spout for receiving a user input; and a bottom wheel rotatably connected to said spout, said bottom wheel being configured in such a manner that said bottom wheel is intermittently rotated as said cam shaft is continuously rotated;

wherein said first and second passageways are intermittently biased between open and closed positions as said bottom wheel becomes intermittently offset and aligned with said first and second passageways such that said first and second items are intermittently permitted and intermittently prohibited from egressing said spout respectively.

9. The multi-chambered container of claim 8, wherein said first and second passageways remain spaced apart along an entire longitudinal length of said cavity.

10. The multi-chambered container of claim 8, wherein said selectively dispensing means further comprises:

a top disc statically mated to said cam shaft and situated above said bottom wheel, said top disc being eccentrically juxtaposed above said bottom wheel such that said top disc rotates along an eccentric curvilinear path defined inwardly from an outer perimeter of said bottom wheel; and first and second stop members directly affixed to a top surface of said bottom wheel, said first and second stop members being intermittently engaged with said top disc as said top disc continuously rotates along said eccentric curvilinear path to thereby intermittently rotate said bottom wheel between the open and closed positions respectively.

11. The multi-chambered container comprising 10, wherein said first and second stop members are oppositely positioned on said bottom wheel and remain approximately 180 degrees apart as said top disc and said bottom wheel are rotated.

12. The multi-chambered container comprising 10, wherein said cam shaft and said top disc are continuously rotated in sync along a first rotational direction as said bottom wheel is intermittently rotated along said first rotational direction.

13. The multi-chambered container comprising 10, wherein said top disc comprises: a shoulder protruding outwardly from an outer perimeter of said top disc, said top disc being intermittently engaged with said first and second stop members and thereby causing said bottom wheel to intermittently rotate along a semi-spherical path extending approximately 180 degrees as said cam shaft and said top disc rotate 360 degrees.

14. The multi-chambered container comprising 13, wherein said first and second stop members intermittently travel along said eccentric curvilinear path such that said first and second stop members become intermittently engaged and disengaged from said shoulder upon reaching a beginning point and an end point of said semi-spherical path respectively;

wherein said beginning and ending points are alternately aligned with said open top ends of said first and second passageways respectively during each complete revolution of said cam shaft.

* * * * *